United States Patent [19]

Triplett

[11] Patent Number: 4,653,656

[45] Date of Patent: Mar. 31, 1987

[54] DOUBLE CENTER LUFFING CRANE

[76] Inventor: James T. Triplett, P.O. Box 769, Chester, S.C. 29706

[21] Appl. No.: 635,750

[22] Filed: Jul. 30, 1984

[51] Int. Cl.[4] ..... B66C 23/52

[52] U.S. Cl. ..... 212/190; 212/256; 212/261

[58] Field of Search ..... 212/182–186, 212/190, 192–194, 211, 227, 231–235, 237–238, 255–256, 260–261, 266

[56] References Cited

U.S. PATENT DOCUMENTS

| | | | |
|---|---|---|---|
| 951,433 | 3/1910 | Carey | 212/256 |
| 1,023,507 | 4/1912 | Davison | 212/256 |
| 1,359,379 | 11/1920 | Holmes | 212/233 |
| 3,557,968 | 1/1971 | Thaeter | 212/233 |
| 3,685,668 | 8/1972 | Suverkrop | 212/256 |
| 3,754,666 | 8/1973 | Suverkrop | 212/238 |

FOREIGN PATENT DOCUMENTS

| | | | |
|---|---|---|---|
| 149860 | 6/1951 | Australia | 212/256 |
| 464500 | 9/1926 | Fed. Rep. of Germany | 212/256 |
| 943319 | 5/1956 | Fed. Rep. of Germany | 212/256 |
| 1481298 | 4/1967 | France | 212/185 |
| 57753 | 5/1979 | Japan | 212/256 |
| 266662 | 12/1964 | Netherlands | 212/185 |
| 6412628 | 5/1966 | Netherlands | 212/185 |
| 212625 | 5/1967 | Sweden | 212/185 |
| 1639 | of 1857 | United Kingdom | 212/256 |
| 424803 | 10/1974 | U.S.S.R. | 212/256 |
| 461890 | 7/1975 | U.S.S.R. | 212/256 |
| 918256 | 4/1982 | U.S.S.R. | 212/233 |

*Primary Examiner*—Trygve M. Blix
*Assistant Examiner*—Stephen P. Avila
*Attorney, Agent, or Firm*—Dority & Manning

[57] ABSTRACT

A load lifting crane for raising the load at a site and moving the load in a substantially horizontal direction to a remote site where the load is lowered. The crane includes a base support member which has a pivotally supported vertically extending mast carried thereon. A substantially horizontally extending boom is carried by the upper end of the mast for pendulous movement. An actuator strut is connected between the upper end of the mast and the base support member so that by selectively varying the length of the actuator strut, the mast is pivoted for shifting the boom. As the boom is shifted, it is shifted in a substantially pendulous movement relative to the mast thereby moving the load-carrying end of the boom substantially horizontally after lifting the load off of a site. There is a rear suspender extending from the base support member to the rear end of the boom and it includes a rear suspender rotational link that engages a stop pin carried on the base of the support member for changing the radius of rotation of the rear suspender as the mast is rotated rearwardly for aiding in maintaining the load at the same height as it is shifted rearwardly.

31 Claims, 10 Drawing Figures

DOUBLE CENTER LUFFING CRANE

BACKGROUND OF THE INVENTION

Heretofore, luffing cranes which are used for lifting and shifting loads in substantially horizontal planes have included substantial amounts of rigging, including booms and extensions for booms. It is desirable, when shifting loads, that after the load is raised it can be shifted in a substantially horizontal plane to a remote site. Normally, when the boom of most conventional cranes is raised as the load is being shifted from one site to a remote site, an operator is required to manipulate at least two levers. One lever is used for raising the boom of the crane, while the other lever is used for manipulating the load line so as to maintain the load in a substantially horizontal plane as the boom is raised for shifting the load to a remote site. This requires substantial skill of an operator. If the operator did not manipulate the load line to maintain the load at the same vertical level as the load was being shifted to a remote site, then additional power would be required to raise the boom of the crane. This, in turn, would require the boom and mast of the crane to be more heavily constructed.

A typical example of a luffing crane is disclosed in U.S. Pat. No. 3,685,668 entitled, "Convertible Level Luffing Crane." Another typical example of a luffing crane is disclosed in U.S. Pat. No. 2,401,238 entitled, "Conical Type Level Luffing Device for Derricks and Jib Cranes."

SUMMARY OF THE INVENTION

In order to avoid the above mentioned problems, a load lifting apparatus constructed in accordance with the present invention has been designed for raising a load at a site and moving the load in a substantially horizontal direction at the same height to a remote site where the load is loaded and deposited. The load lifting apparatus includes a base support member which has a pivotal connector carried thereon. A substantially vertically extending mast having an upper and lower portion is pivoted on the pivotal connector about the lower portion of the mast. A substantially horizontally extending boom is suspended on an upper portion of the mast for pendulous movement. A draw works is carried by the base support member, and a load line extends about the load carrying end of the boom, the upper portion of the mast, and is attached to the draw works for raising and lowering the load. Means are provided for selectively pivoting the mast about the pivotal connector in a vertical plane causing the boom to be shifted in a pendulous movement relative to the mast for moving the load-carrying end of the boom substantially horizontally after lifting the load off the site.

In one particular embodiment, the means for selectively pivoting the mast includes an actuator strut which is connected between an upper portion of the mast and the base support member. The effective length of the actuator strut can be varied for pivoting the mast about the pivotal connector.

The means for suspending the boom on the mast for pendulous movement includes a forward boom pendant extending between the load carrying end of the boom and an upper portion of the mast, and a rear pendant extending between the upper portion of the mast and the rear end of the boom.

A rear restraint extends from adjacent the base support member and the rear end of the boom. In one particular embodiment, the rear restraint is connected by a rear restraint rotational link having an upper end and a lower end. The lower end of the rear restraint rotational link is pivotally connected to the base support member through a rear restraint pivotal connector. A rotational stop pin is carried on the base support member for engaging the rear restraint rotational link when the rear restraint rotates past a predetermined point, so that upon engagement of the stop pin by the rotational link, the rear restraint rotates about the upper end of the rear restraint rotational link instead of the rear restraint pivotal connector. Such aids in maintaining the load carrying end of the boom at the same height as it is moved to and fro with the load. In one particular apparatus, a pair of laterally spaced masts support a pair of laterally spaced booms in a pendulous manner. Each of the booms is equipped with a load line so that when lifting a large load, the load line of each boom can be connected to the load at different positions for preventing the load from rotating.

The crane constructed in accordance with the present invention can be readily erected and collapsed by the use of a midpoint erection pin which is inserted through the boom and the mast for securing the boom to the mast. Once the midpoint erection pin is inserted through the boom and the mast, a head pin around which the load line extends, can be removed and the hydraulically operated acutating cylinder can be used for lowering the mast and boom to a collapsed position. Prior to lowering the mast and boom, the rotational stop pin, which in normal operation is used for preventing the rear restraint link from rotating past a predetermined point, is removed.

Accordingly, it is an important object of the present invention to produce a simple and efficient crane for raising and shifting loads.

Another important object of the present invention is to provide a simple and reliable crane that can be readily erected and collapsed for transporting.

Another important object of the present invention is to provide a crane which includes a mast that has a boom supported thereon for pendulous movement relative to the mast for moving a load at a predetermined level as the load is shifted from one site to another site.

Still another important object of the present invention is to provide a crane that can be readily mounted on a rail for being shifted.

Yet another important object of the present invention is to provide a crane that can be readily supported on a flotation device for unloading ships and the like or for use in constructing bridges over water.

The construction designed to carry out the invention will be hereinafter described, together with other features thereof.

The invention will be more readily understood from a reading of the following specification and by reference to the accompanying drawing(s) forming a part thereof, wherein an example of the invention is shown and wherein:

DESCRIPTION OF PREFERRED EMBODIMENT

Figure 1:
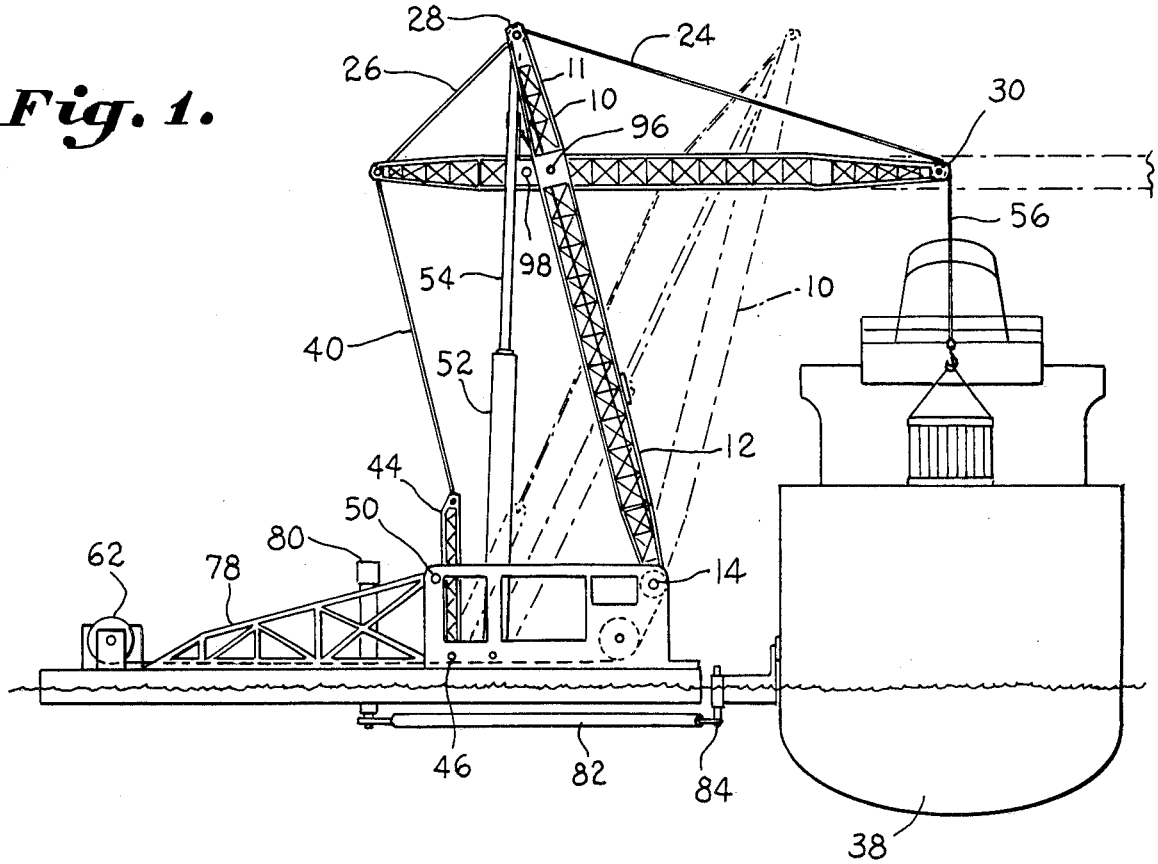
FIG. 1 is a side elevational view illustrating a crane constructed in accordance with the present invention.

Referring to FIG. 1 of the drawings, there is illustrated a crane constructed in accordance with the present invention. The crane includes a mast 10 constructed of steel with suitable conventional bracing. The mast has an upper end 11 and a lower end 12 which is pivotally supported on a pivotal connector 14 which extends between a pair of side frame members 16 and 18. The pivotal connector 14 includes a shaft 15 which extends through a bearing carried on the lower end of the mast 12 and 12*a*. A pair of booms 20 and 22 are supported from the upper end of the mast by means of a forward boom pendant 24 and a rear boom pendant 26. The forward boom pendant 24 has one end connected to the head pin 28 and the other end connected to the load-carrying end 30 of the boom. By supporting the booms 20 and 22 on the forward boom pendants 24 and rear boom pendants 26 in the manner shown in FIGS. 1, 2, and 3, the boom is permitted to swing in a pendulous manner about the head pin 28.

Both the booms 20 and 22 and the masts 10 and 10*a* are constructed of steel with suitable conventional reenforced cross-bracing. The forward boom pendant 24 and the rear boom pendant 26 are constructed of suitable conventional cable.

The outer end of the forward boom pendant 24 is fixed to the load-carrying end 30 of the booms 20 and 22. The inner ends of the forward boom pendant 24 are, in turn, fixed to a sleeve 32 encompassing the head pin 28.

The rear boom pendants 26 have their lower ends connected to the rear ends of the booms 20 and 22, respectively. The upper ends of the rear boom pendants 26 are, in turn, connected to the sleeve 32.

There is suitable bracing 34 extending between the laterally spaced booms 20 and 22 to maintain them in a spaced relation.

Figure 8:
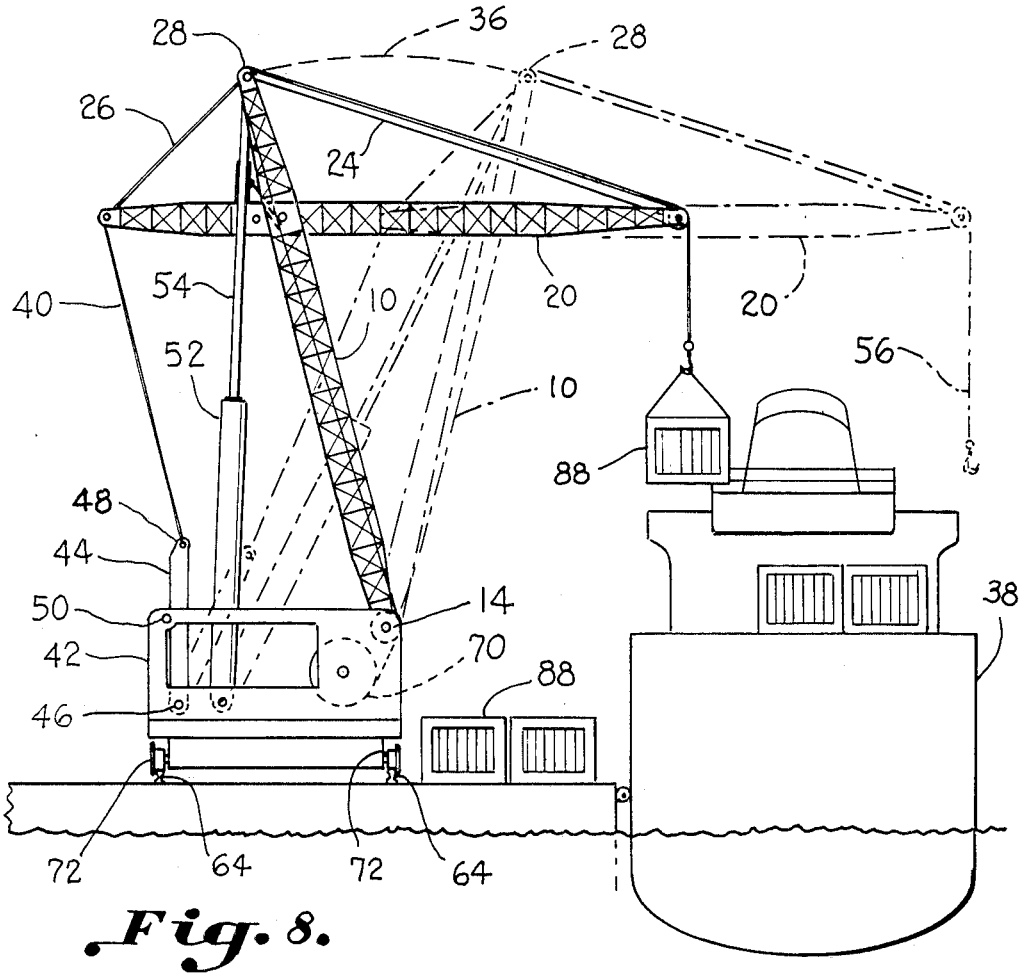
FIG. 8 is a side elevational view of a crane constructed in accordance with the present invention mounted on rails.
Figure 7:
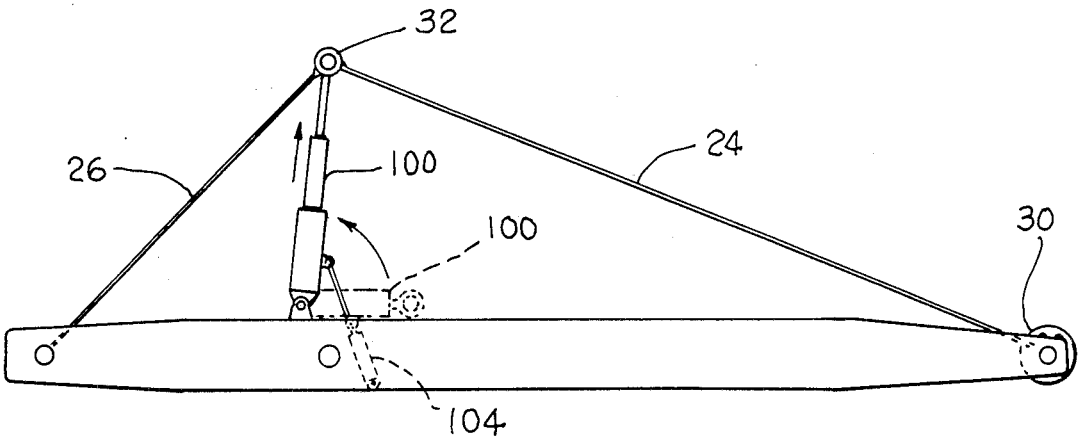
FIG. 7 is an enlarged side elevational view illustrating the manner in which a forward and rear boom pendant is raised and lowered during the collapsing of the crane.
Figure 9:
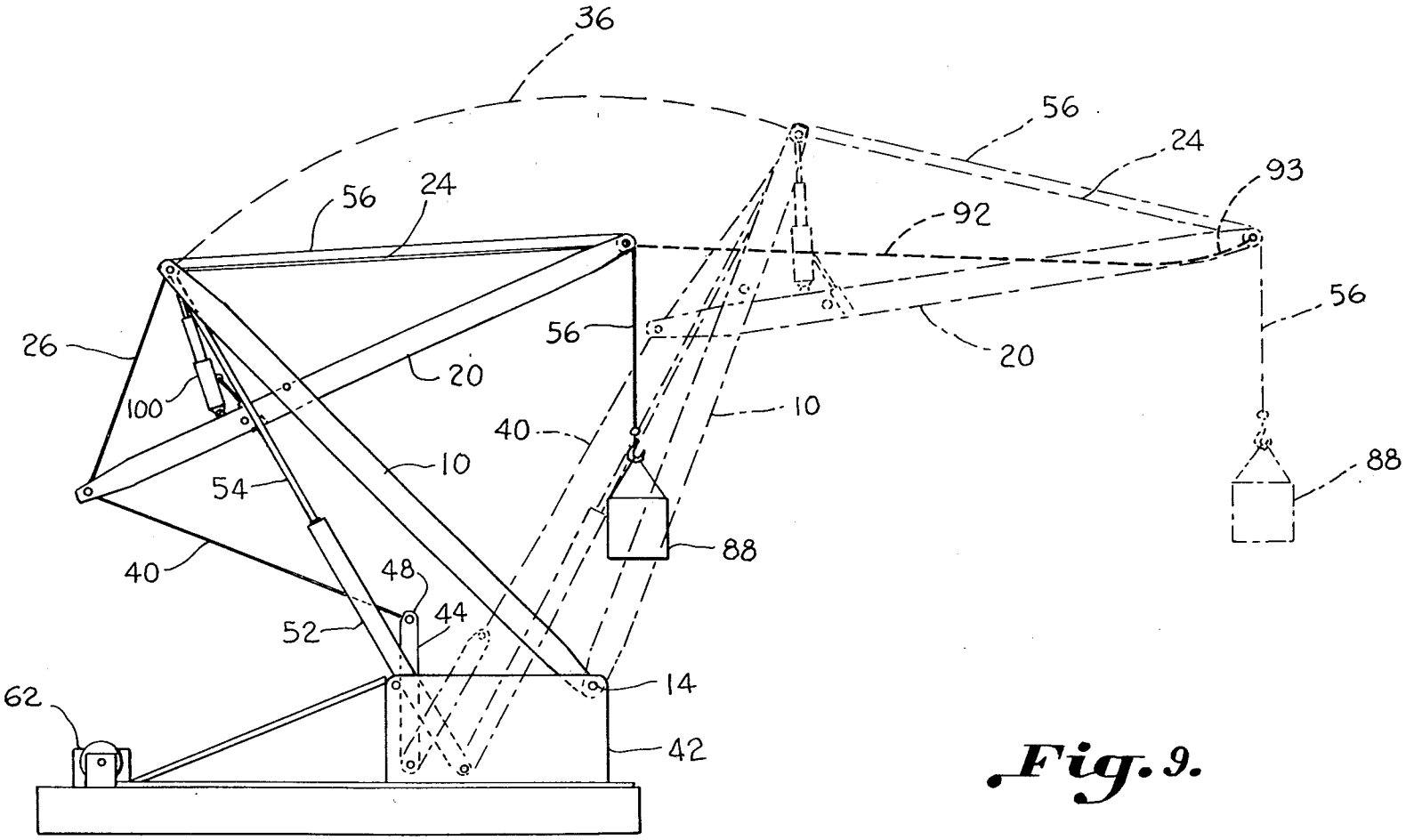
FIG. 9 shows in a schematic form the various positions of the boom and mast during operation.

As a result of the booms 20 and 22 being supported by the forward and rear boom pendants 24 and 26, the booms 20 and 22 are permitted to move relative to the masts 10 and 10*a* in a pendulous movement responsive to the masts being pivoted about pivotal connector 14. As seen in FIGS. 8 and 9 when the masts 10 and 10*a* are pivoted about the pivotal connector 14, the head pin 28 follows the arcuate path shown in broken lines 36. If the masts were to remain in a vertical position and the booms were somehow moved to and from the ship 38, the booms 20 and 22 would tend to rise at the end of their stroke similar to the weight on a pendulum of a clock. However, in order to maintain the booms substantially horizontal as they move back and forth, the head pin 28 moves about the arcuate path 36 due to the pivoting of the mast 10 about the pivotal connector 14. This causes the booms to move during the majority of their stroke in a horizontal plane.

In order to permit the mast to pivot to an even greater extent without substantially raising and lowering the load end 30 of the boom, a rear restraint 40 is connected between the rear end of the boom and a base support member 42.

Figure 3:
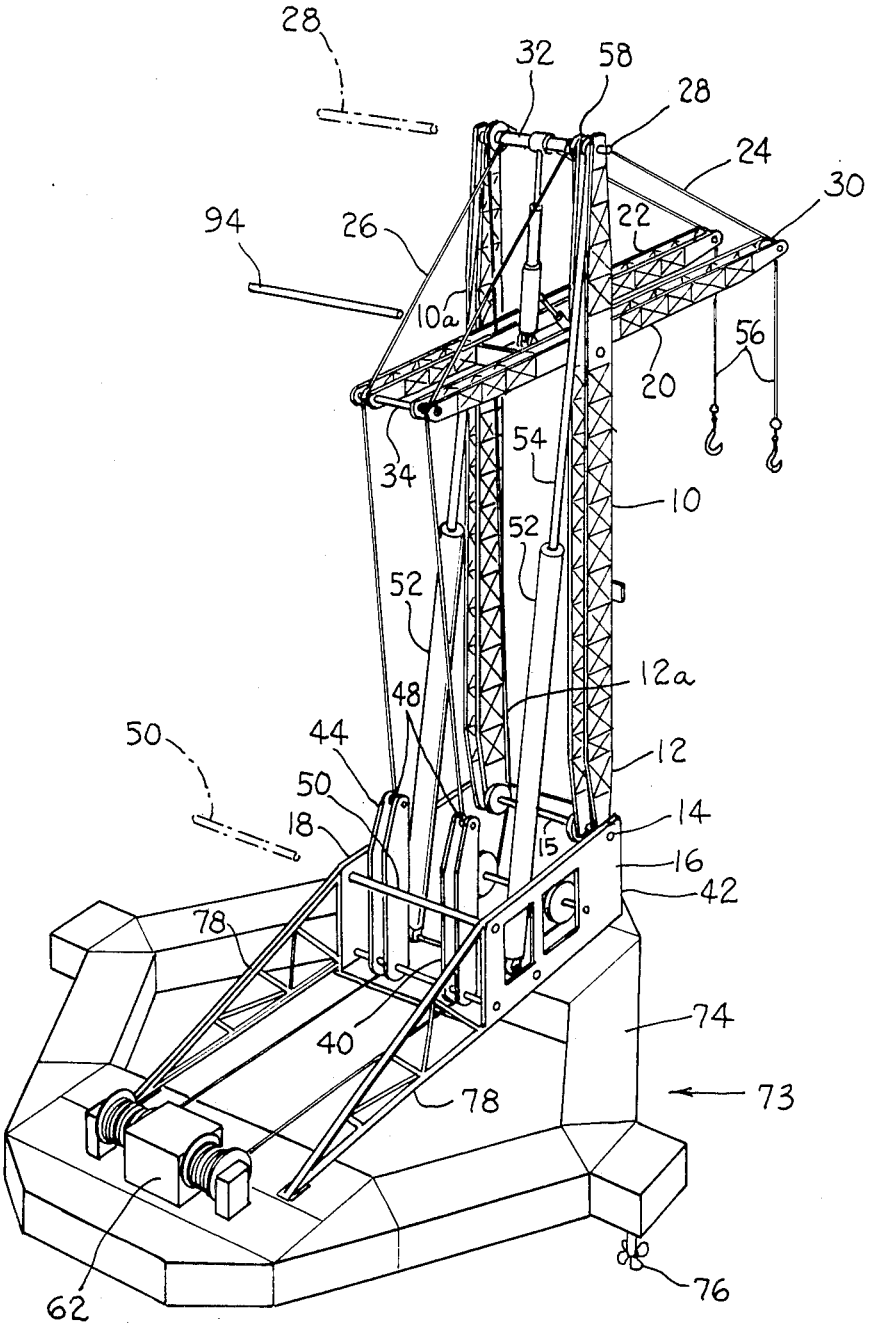
FIG. 3 is a perspective view illustrating the crane shown in FIGS. 1 and 2.

The rear restraint 40 includes a rear restraint rotational link 44. The rear restraint rotational link has its lower end pivotally supported on a rear restraint pivotal connector 46 extending between side braces 16 and 18 of the base support member 42. The upper end of the rear support rotational link 44 is connected to the rear restraint 40 which is in the form of a cable. The rear restraint rotational link 44 and the rear restraint 40 together form a control radius which constrains the rear end of the boom as it pivots about base support member 42. As shown in FIG. 3, each of the masts and booms is equipped with identical rigging. Only one particular rigging will be described since the operation is identical for all of the components, and they are merely duplicated. Each of the rear restraint rotational links 44 are constructed of a pair of rigid steel plates better shown in FIG. 3. A pin 48 extends between the plates of rear restraint rotational link 44 for moving the lower end of the rear restraint 40. In order to prevent the rear restraint 40 from pivoting rearwardly beyond its vertical position as shown in FIG. 8, there is provided a rotational stop pin 50 that extends between the side plates 16 and 18 of the base support member 42. The operation and purpose of the rear restraint rotational link 44 and rotational stop pin 50 will be discussed more fully below.

An acutator strut means 52 is provided for pivoting the masts 10, 10*a* about the pivotal connector 14 for moving the booms 20 and 22 back and forth in order to transfer a load from a site to a remote site.

In one particular embodiment, the actuator strut 52 includes a double-acting hydraulically operated cylinder which has a piston 54 extending out the upper end thereof. The lower end of the cylinder 52 is pivotally secured between the side plates 16 and 18 of the base support member 42. For purposes of clarity, the hydraulic hoses connected to the cylinder 52 are not shown. The upper end of the piston 54 is pivotally connected to the upper end 11 of the mast through a suitable connector.

Each of the masts 10 and 10*a* and boom 20 have a load line 56 associated therewith. The path of the load line 56 extends around a boom point sheave carried on the load-carrying end 30 of the boom, another sheave 58 carried adjacent the upper end 11 of the masts 10 and 10*a* still another sheave (not shown) on the pivotal connector 14 and to the draw works 62 carried on the rear of the flotation device 73 as seen in FIG. 3.

When the base support member 42 is mounted on rails 64 as shown in FIG. 8, the draw works 70 is carried between the side frame members 16 and 18 which are, in turn, suitably supported on wheels 72 which ride on the rails 64.

Referring back to FIGS. 1, 2 and 3 of the drawing, the entire crane is supported on a flotation device similar to that disclosed in U.S. Pat. No. 4,359,164 entitled, "Floating Crane Apparatus." The flotation device 73 is described more fully in the patent and includes pontoons 74 which are suitably joined together. Hydraulically operated motors are used for operating propellors 76 for rotating the entire pontoon flotation device. The flotation pontoons 73 can be disassembled for transporting, similar to that shown in the above mentioned patent. Suitable truss work 78 extends between the base support member 42 and the flotation pontoons 74 for securing the crane on the flotation device 73 such as shown in FIGS. 1∝3.

The flotation device 73 can be attached to the side of the ship by any suitable apparatus such as that disclosed in U.S. Pat. No. 4,442,943 entitled, "Floating Crane Stabilizer," for permitting such to rotate about a spud 80. The lower end of the spud 80 extends through a hole provided in the inner end of arm 82. The outer ends of the arms 82 are pivotally connected through a pivot joint 84 to a floating structure that is, in turn, attached to the side of a ship 38 by any suitable means such as electromagnets 86.

An operator's cab can be suitably mounted anywhere on the crane or flotation device as long as it is positioned so that the operator can readily see the site from which a load is being moved and the remote site to which the load is being transferred. In some applications, it may be desirable to mount the operator's cab between the upper ends of the masts. In other environments, the operator cab may be supported on the base support member 42 or the flotation device 73. Such depends primarily on the particular application for which the crane is to be utilized.

First, the operation will be discussed in connection with the crane disclosed in FIG. 1 which is supported on the flotation device 73. In the embodiment shown in FIG. 1, the crane is positioned for lifting the load off of the deck of the ship and transferring it to a dock on the opposite side of the ship (not shown). When it is desired to transfer a container 88 from a ship to a receiving dock on the other side of the ship, first the operator supplies fluid to the lower end of the hydraulic cylinder 52 causing the masts 10 and 10*a* to pivot forward to a point where the load-carrying end 30 of the booms 20 and 22 are over the load that is to be lifted. The load is then lifted by operating the draw works 62 to lift the load to a predetermined height. The operator then applies additional fluid to the lower end of the cylinder 52 causing the mast as shown in FIGS. 1 and 3 to pivot forward to the phantom line position wherein the load-carrying end is positioned beyond the other side of the ship over the receiving dock. The load is then deposited on the dock by again operating the draw works 62.

Figure 2:
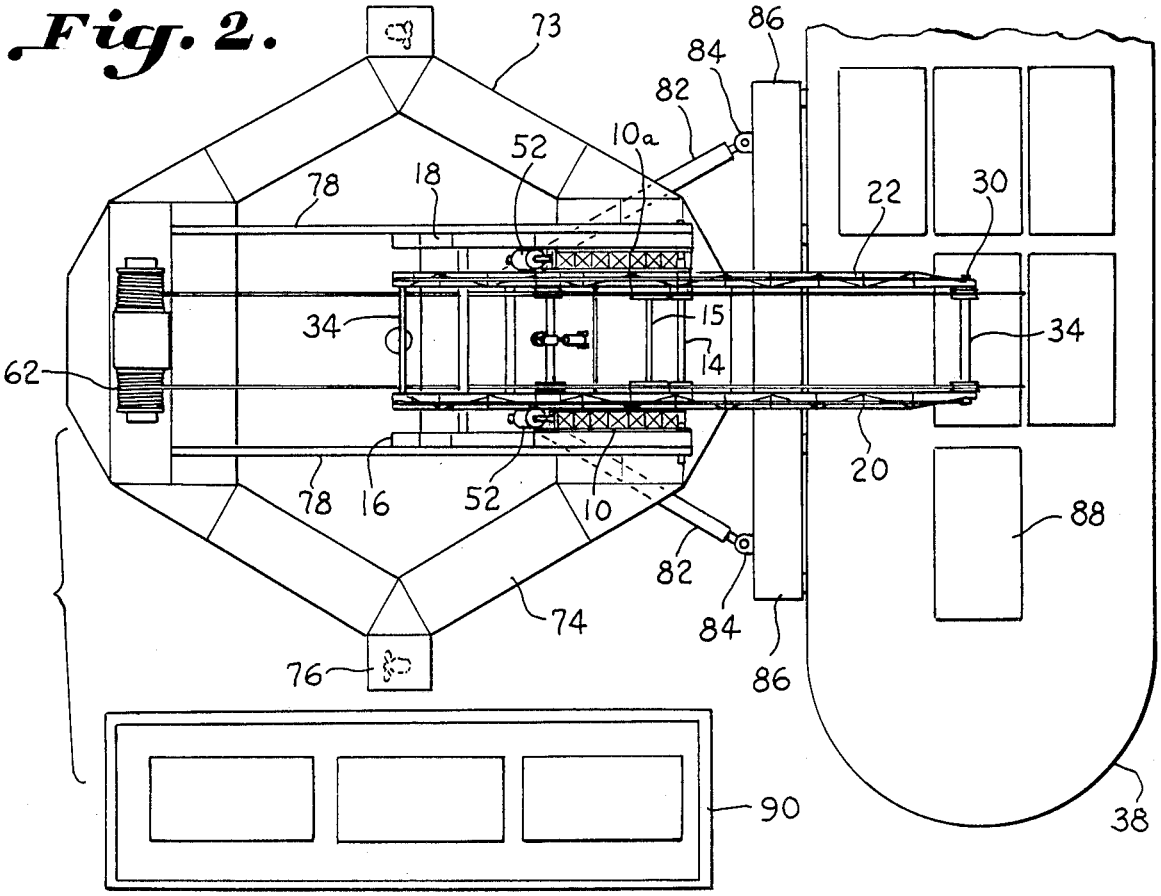
FIG. 2 is a plan view illustrating the crane of FIG. 1.

In FIG. 2, there is shown a receiving barge 90 that is positioned on the same side of the ship as the flotation device 73. In this particular embodiment, after the container 88 is lifted off the deck of the ship, the flotation device 73 is rotated by the propellors 76 until the load-carrying end 30 of the boom is positioned over the barge 90. At this point, the draw works 62 is manipulated for depositing the container 88 on the barge 90.

In FIG. 8, as previously mentioned, the base support member 42 is mounted on rails 64. First, hydraulic fluid is applied to the lower end of the cylinder 52 to pivot the mast 10 forward so that the load-carrying end 30 of the boom is over the container that is to be lifted. The draw works 70 is manipulated in any suitable manner for raising the container 88 to a predetermined height. After the container has been raised to a predetermined height, hydraulic fluid is supplied to the upper end of the hydraulic cylinder 52 for retracting the piston 54. This causes the head pin 28 carried by the upper end of the mast 10 to pivot rearwardly about the arcuate path designated by the reference character 36. When the load-carrying end 30 is over the side of the dock, the container is lowered by manipulating the draw works 70 for depositing the container on a portion of the dock between the rails 64 and the ship 38.

The base support member 42 can be equipped with suitable drive mechanism for driving the wheels 72 for moving the entire crane along the rails for depositing the container at another remote location.

As seen in FIG. 8, as the boom is pivoted about the pivotal connector 14, the upper end thereof from which the boom 20 is supported pivots about the arcuate path 36. The boom 20 moves in a pendulous type of movement relative to the headpin as the mast pivots, and because the headpin moves about the arcuate path 36, the boom, and particularly the load-carrying end, remains substantially horizontal during the majority of its travel.

In order to ensure that the load-carrying end remains at substantially the same height as the mast is pivoted rearwardly about the pivotal connector 14, the rotational link 44 strikes the rotational stop pin 50. This causes the rear restraint 40 to rotate about the upper pivot pin 48 of the rear restraint rotational link 44 instead of the rear restraint pivotal connector 46 to ensure that the load-carrying end 30 remains at substantially the same height, even though the rear end of the boom 20 will begin to pivot slightly downwardly at the very end of its stroke. The downward pivoting of the rear end of boom 20 causes the forward end of the boom 20 to rise, thereby raising the load 88. The work expended by the boom 20 in this raising of the load 88 acts to retard further rearward pivoting of the boom 20.

FIG. 9 shows an exaggerated rearward pivoting of the mast 10, and the load 88 is slightly over the base support member 42. Normally the remote site would not be this far rearward since, if the load was unloaded in the position as shown in FIG. 9, it would strike the base support member 42. The purpose of this drawing is primarily to show the horizontal path 92 that the load-carrying end 30 of the boom travels during its working stroke. It can be seen that the load-carrying end, when it reaches its fully outward stroke, tends to rise as indicated by the reference character 93. This causes a strain on the working mechanism of the crane signaling to the operator that the maximum length of the stroke has been reached.

Figure 4:
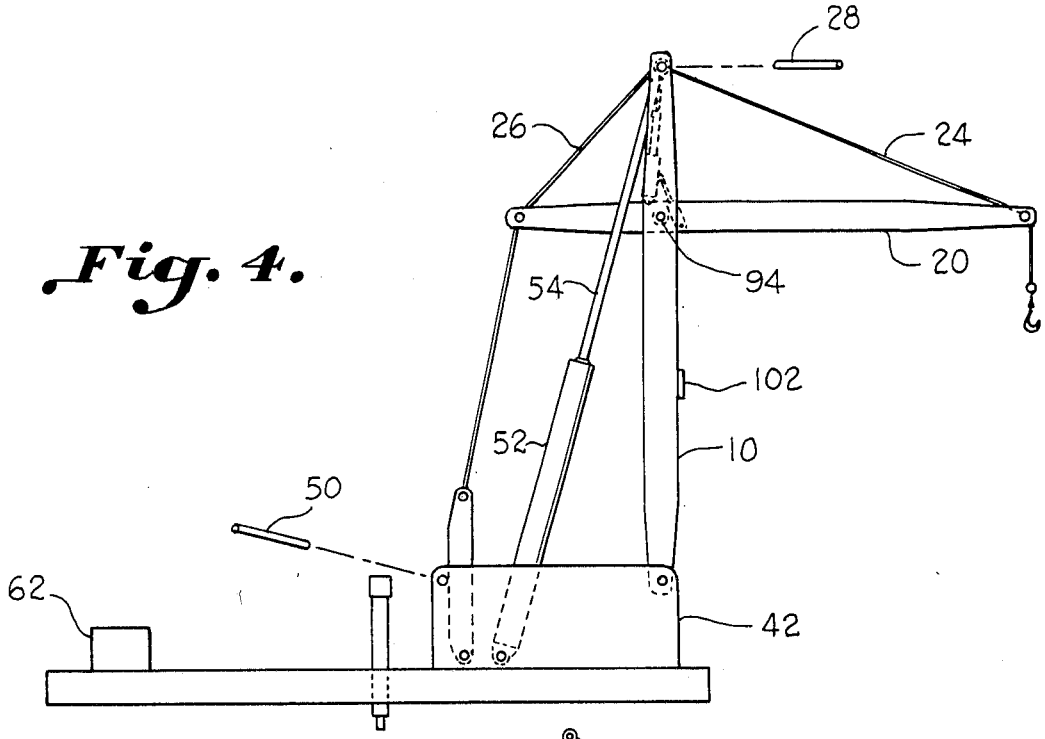
FIGS. 4–6 show in schematic form the various positions of the crane when being collapsed and erected.
Figure 5:
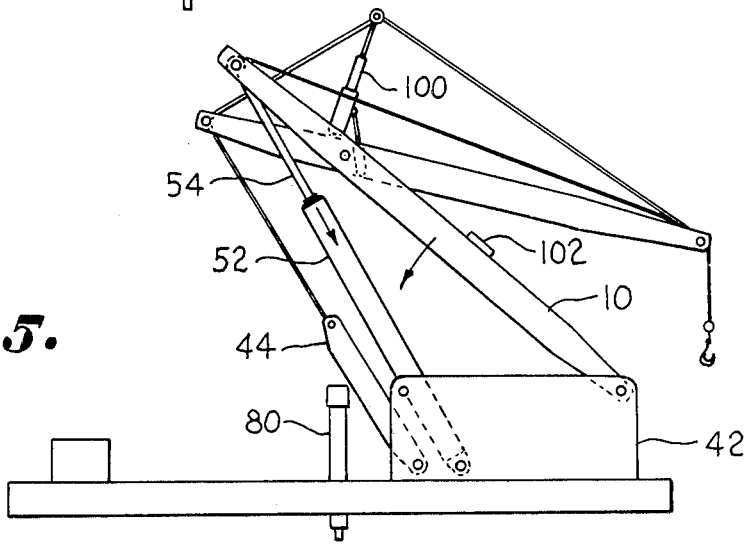
Figure 6:
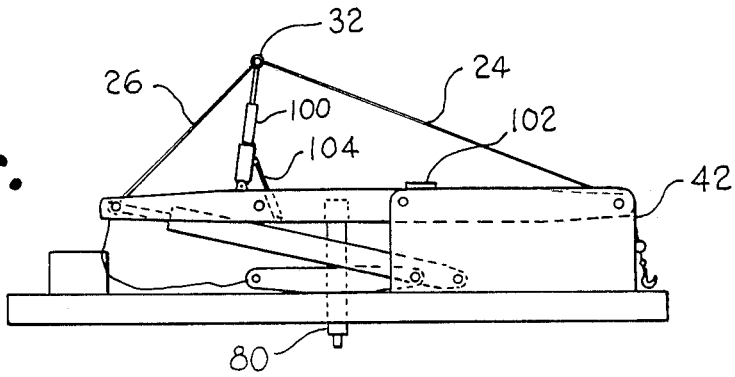

The manner in which the crane can be collapsed for transporting is shown schematically in FIGS. 4–6. In order to collapse the crane, first, a midpoint erection pin 94 is inserted through sleeves 96 and 98, as shown in FIG. 1, carried in the mast 10 and the boom 20, respectively, for fixing the boom 20 to the mast. The headpin 28 is then removed allowing the rear boom pendant 26 and forward boom pendant 24 to be supported solely on the upper end of a telescoping link 100. The rotational stop pin 50 is then removed from between the side plates 16 and 18 of the base support member 42. Hydraulic fluid is applied to the upper end of the hydraulic cylinder 52 causing the piston 54 to be retracted. As the piston 54 is retracted, it causes the mast 10 to pivot from the vertical position such as shown in FIG. 4, through the inclined position shown in FIG. 5, and to a lower horizontal position shown in FIG. 6. Stops 102 are carried on the masts for engaging the side supports 16 and 18 for limiting the downward movement of the mast to the horizontal position shown in FIG. 6.

The telescoping link 100 includes segments that are extended and retracted by supplying hydraulic fluid to a cylinder carried thereon. When the hydraulic fluid is fed in one direction, the segments of the telescoping link 100 are retracted one within the other. Another hydraulic cylinder 104 is used for pivoting the telescoping link down to a horizontal position along side of mast 10. Such position is not shown in the drawing. The sole purpose of the telescoping link 100 is to raise the sleeve 32 so that it can be aligned with sleeves carried in the upper end of the mast through which the headpin 28 is inserted. When the sleeve 32 is raised, it also raises the rear boom pendant 26 and the forward boom pendant 24 to their proper operating positions. It is to be understood, of course, that any suitable mechanism could be used in place of the telescoping link 100 and its sole purpose is to aid in erecting the crane and in particular in aligning the sleeve 32 with the holes provided in the masts for receiving the headpin 28.

Figure 10:
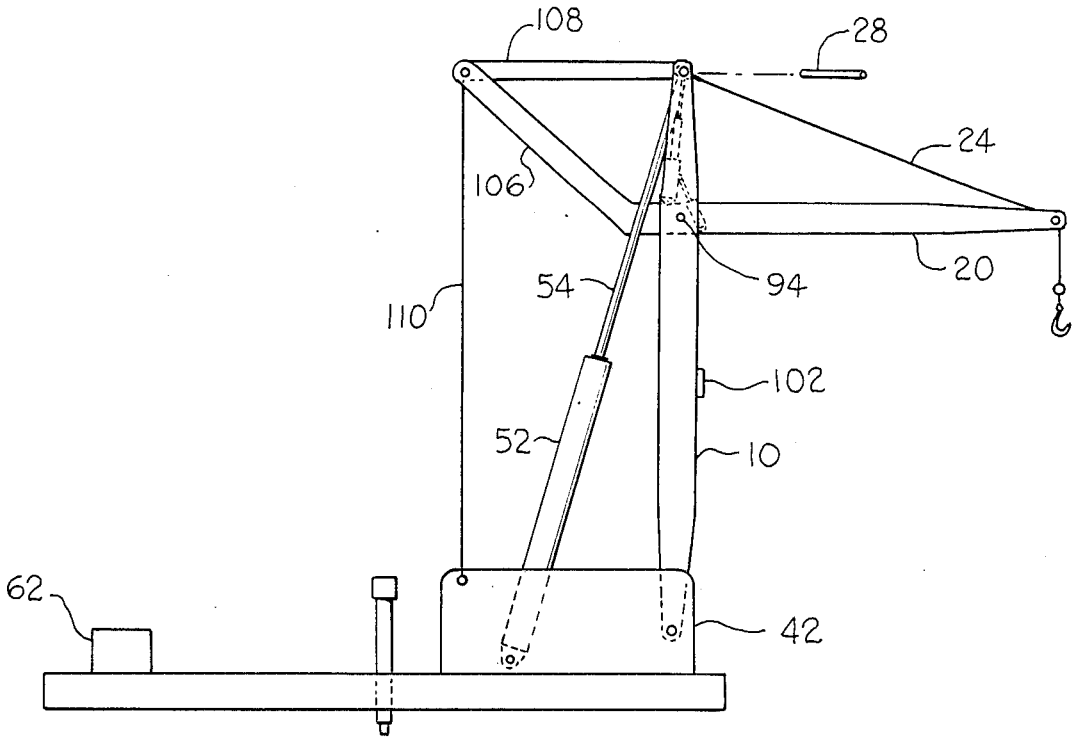
FIG. 10 is a side elevational view of an alternate embodiment of the present invention.

In FIG. 10, there is illustrated an alternate embodiment of the invention. Instead of utilizing a rear restraint 40, which includes a rear suspender rotational link 44 and a rotational stop pin 50, the rear end of the boom can be modified. A rear portion of the boom 20 has an inclined brace 106 extending upwardly at an angle to join a rigid member 108 that extends horizontally outwardly from the top of the mast. A rear restraint cable 110 extends from the junction of the two braces 106 and 108 to a pivotal connection point 112 carried between the side members 16 and 18 of the base support member 42. The operation of the actuator means 52 pivoting the mast, including the feature where the load carrying end of the boom rises slightly as it moves over pivotal connector 14, 10 is the same as described above in the connection with the embodiments of FIGS. 1–9.

As a result of the addition of the braces 106 and 108, the boom 20 and the rigid members 106 and 108 pivot about the head pin 28 positioned adjacent the top of the mast. When the mast 10 is pivoted about the pivotal connector 14, this causes the load-carrying end of the boom to remain at substantially the same horizontal level as the mast is pivoted for shifting loads.

It will be understood, of course, that while the form of the invention herein shown and described constitutes a preferred embodiment of the invention, it is not intended to illustrate all possible forms of the invention. It is also understood that the words used are words of description rather than of limitation and that various changes may be made without departing from the spirit and scope of the invention herein disclosed.

What is claimed is:

1. A load lifting apparatus for raising a load at a site and moving said load in a substantially horizontal direction to a remote site where said load is lowered and deposited, said load lifting apparatus comprising:

a base support member;

a pivotal connector carried by said base support member;

a substantially vertically extending mast having an upper portion and a lower portion;

said lower portion of said mast being pivotally supported on said pivotal connector for being pivoted penetratingly through a vertically extending plane extending upward from said pivotal connector;

a substantially horizontally extending boom having a load carrying end and a rear end;

means for suspending said boom on an upper portion of said mast for pendulous movement;

a draw works carried by said base support member;

a load line means extending about said load carrying end of said boom, said upper portion of said mast, and to said draw works for raising and lowering said load;

means for selectively pivoting said mast about said pivotal connector through said vertical plane, causing said boom to be shifted in a pendulous movement relative to said mast for moving said load-carrying end of said boom substantially horizontally after lifting said load off said site and control radius means having an effective length dependent on the position of said boom relative to said mast connected between said rear end of said boom and said base support member for allowing constrained pivoting of said rear end of said boom with respect to said base support member.

2. The load lifting apparatus as set forth in claim 1 wherein:

said means for selectively pivoting said mast includes:

(i) an actuator strut means connected between said upper portion of said mast and said base support member;

(ii) means for selectively varying the length of said acutator strut for pivoting said mast about said pivotal connector.

3. The load lifting apparatus as set for in claim 1 wherein:

said means for suspending said boom on an upper portion of said mast for pendulous movement includes:

(i) a forward boom pendant extending between said load-carrying end of said boom and said upper portion of said mast; and (ii) a rear boom pendant extending between said upper portion of said mast and said rear end of said boom.

4. The load lifting apparatus as set forth in claim 3 wherein said control radius means includes:

a rear restraint extending from adjacent said base support member to said rear end of said boom opposite said load carrying end of said boom.

5. The load lifting apparatus as set forth in claim 1 wherein said control radius means includes:

(i) a rear restraint pivotal connector carried by said base support member;

(ii) a rear restraint rotational link having an upper end and a lower end, said lower end being pivotally connected to said rear restraint pivotal connector;

(iii) a rear restraint from said upper end of said rear restraint rotational link to said rear end of said boom opposite said load-carrying end of said boom, said rear restraint mounted for rotation about said rear restraint pivotal connector as said rear end of said boom moves;

(iv) a rotational stop pin carried on said base support member for engaging said rear restraint rotational link when said rear restraint rotates past a predetermined point so that upon engagement of said stop pin with said rotational link, said rear restraint rotates about said upper end of said rear restraint rotational link instead of said rear restraint pivotal connector, thereby changing the effective length of the radius of rotation of said rear end of said boom about said base support member.

6. The load lifting apparatus as set forth in claim 1 wherein said substantially vertically extending mast includes a pair of laterally spaced masts, and said substantially horizontally extending boom being suspended from upper portions of said pair of masts.

7. The load lifting apparatus as set forth in claim 1 wherein said substantially horizontally extending boom includes a pair of laterally spaced booms, said pair of laterally spaced booms being suspended from an upper portion of said mast.

8. The load lifting apparatus as set forth in claim 1 further comprising rail means attached to said base support member for permitting movement of said base support member on said rail means.

9. The load lifting apparatus as set forth in claim 1 further comprising flotation means attached to said base support member for permitting said base support member to be buoyantly supported on a body of fluid.

10. The load lifting apparatus as set forth in claim 2 wherein said actuator strut means is a fluid actuated piston-cylinder.

11. The load lifting apparatus as set forth in claim 1 further comprising:

(i) a midpoint erection and collapsing pin;

(ii) means for removably receiving said midpoint erection and collapsing pin in said boom and adjacent said upper portion of said mast;

(iii) a head pin; and (iv) means for removably receiving said head pin in said mast adjacent said upper portion of said masts.

12. The load lifting apparatus as set forth in claim 11 further comprising an expandable linkage means mounted on said boom, between said rear end of said boom and said load-carrying end of said boom, and extending from said boom to said means for removably receiving said head pin for moving said means for removably receiving said head pin.

13. The load lifting apparatus as set forth in claim 11 wherein said substantially vertically extending mast includes a pair of laterally spaced masts, and said substantially horizontally extending boom being suspended from said upper portion of said pair of masts.

14. The load lifting apparatus as set forth in claim 13 wherein said substantially horizontally extending boom includes a pair of laterally spaced booms, and said pair of laterally spaced booms being suspended from an upper portion of said mast.

15. A load lifting apparatus for raising a load at a site and moving said load in a substantially horizontal direction to a remote site where said load is lowered and desposited, said load lifting apparatus comprising:

a base support member;

a pivotal connector carried by said base support member;

two substantially vertically extending masts each having an upper portion and a lower portion;

said lower portion of each of said masts being pivotally supported on said pivotal connector for being pivoted penetratingly through a vertically extending plane extending upward from said pivotal connector;

a substantially horizontally extending boom having a load-carrying end and a rear end;

means for suspending said boom on an upper portion of each of said masts for pendulous movement;

a draw works carried by said base support member;

a load line means extending about said load-carrying end of said boom, said upper portion of each of said masts, and to said draw works for raising and lowering said load;

means for selectively pivoting each of said masts about said pivotal connector through said vertical plane, causing said boom to be shifted in a pendulous movement relative to said masts for moving said load-carrying end of said boom substantially horizontally after lifting said load off said site and control radius means having an effective length dependent on the position of said boom relative to said mast connected between said rear end of said boom and said base support member for allowing constrained pivoting of said rear end of said boom with respect to said base support member.

16. The load lifting apparatus as set forth in claim 15 wherein:

said means for selectively pivoting said masts includes:

(i) an actuator strut means connected between said masts and said base support member;

(ii) means for selectively varying the length of said acutator strut for pivoting said masts about said pivotal connector.

17. The load lifting apparatus as set forth in claim 15 wherein:

said means for suspending said boom on an upper portion of said masts for pendulous movement includes:

(i) a forward boom pendant extending between said load-carrying end of said boom and said upper portions of said masts; and (ii) a rear boom pendant extending between said upper portion of said masts and said rear end of said boom.

18. The load lifting apparatus as set forth in claim 15 wherein said control radius means includes:

a rear restraint extending from adjacent said base support member to said rear end of said boom opposite said load-carrying end of said boom.

19. The load lifting apparatus as set forth in claim 15 wherein said control radius means includes:

(i) a rear restraint pivotal connector carried by said base support member;

(ii) a rear restraint rotational link having an upper end and a lower end, said lower end being pivotally connected to said rear restraint pivotal connector;

(iii) a rear restraint extending from said upper end of said rear restraint rotational link to said rear end of said boom opposite said load-carrying end of said boom, said rear restraint mounted for rotation about said rear restraint connector as said rear end of said boom moves;

(iv) a rotational stop pin carried on said base support member for engaging said rear restraint rotational link when said rear restraint rotates past a predetermined point so that upon engagement of said stop pin with said rotational link, said rear restraint rotates about said upper end of said restraint rotational link instead of said rear restraint pivotal connector, thereby changing the effective radius of rotation of said rear end of said boom about said base support member.

20. The load lifting apparatus as set forth in claim 16 wherein said substantially horizontally extending boom includes a pair of laterally spaced booms, said pair of laterally spaced booms being suspended from an upper portion of each of said masts.

21. The load lifting apparatus as set forth in claim 20 wherein said control radius means includes:

(i) a rear restraint pivotal connector carried by said base support member;

(ii) a rear restraint rotational link having an upper end and a lower end, said lower end being pivotally connected to said rear restraint pivotal connector;

(iii) a rear restraint extending from said upper end of said rear restraint rotational link to said rear ends of said booms opposite said load-carrying end of said booms, said rear restraint mounted for rotation about said rear restraint pivotal connector as said rear end of said booms move;

(iv) a rotational stop pin carried on said base support member for engaging said rear restraint rotational link when said rear restraint rotates past a predetermined point so that upon engagement of said stop pin with said rotational link, said rear restraint rotates about said upper end of said rear restraint rotational link instead of said rear restraint pivotal connector, thereby changing the effective radius of rotation of said rear ends of said booms about said base support member.

22. The load lifting apparatus as set forth in claim 16 wherein said actuator strut means includes a fluid actuated piston-cylinder.

23. The load lifting apparatus as set forth in claim 20 wherein said actuator strut means further includes a fluid actuated piston-cylinder connected between said upper portion of each said mast and said base support member.

24. The load lifting apparatus as set forth in claim 20 wherein said control radius means includes:

(i) two rear restraint pivotal connectors carried by said base support member;

(ii) two rear restraint rotational links each having an upper end and a lower end, said lower end of each being pivotally connected to said base support member;

(iii) two rear restraints each one extending from said upper end of each said rear restraint rotational link to to each said rear end of each said boom opposite said load-carrying end of each said boom, said rear restraints mounted for rotation about said rear restraint pivotal connectors as said rear ends of said booms move;

(iv) a rotational stop pin carried on said base support member for engaging said rear restraint rotational links when each said rear restraint rotates past a predetermined point so that upon engagement of said stop pin with said rotational links, said rear restraint rotate about each said upper end of said rear restraint pivotal connectors, thereby changing the effective radius of rotation of said rear ends of said booms about said base support member.

25. A load lifting apparatus for raising a load at a site and moving said load in a substantially horizontal direction to a remote site where said load is lowered and deposited, said load lifting apparatus comprising:

a base support member;

two pivotal connectors carried by said base support member;

two substantially vertically extending masts each having an upper portion and a lower portion;

said lower portions of said masts being pivotally supported on said pivotal connectors for being pivoted penetratingly through a vertically extending plane extending upward from said pivotal connectors;

two substantially horizontally extending booms each having a load-carrying end and a rear end;

means for suspending said booms on an upper portion of each of said masts;

a draw works carried by said base support member;

a load line means extending about each of said load carrying end of each said boom, said upper portions of each said mast, and to said draw works for raising and lowering said load;

means for selectively pivoting said masts about said pivotal connectors through said vertical plane, causing said booms to be shifted relative to said masts for moving said load substantially horizontally after being lifted off said site and control radius means having an effective length dependent on the position of said boom relative to said mast connected between said rear end of said boom and said base support member for allowing constrained pivoting of said rear end of said boom with respect to said base support member.

26. The load lifting apparatus as set forth in claim 1, further comprising:

said control radius means also retarding extreme rearward pivoting of said boom and said mast as the load penetrates said vertically extending plane extending upwardly from said pivotal connector, during substantially horizontal rearward movement of the load.

27. The load lifting apparatus as set forth in claim 26, wherein said control radius means retarding extreme rearward pivoting of said boom and said mast by causing said load carrying end of said boom to rise adjacent the end of its maximum rearward movement acting to retard extreme rearward pivoting of said boom and said mast.

28. The load lifting apparatus as set forth in claim 15, further comprising:

said control radius means also retarding extreme rearward pivoting of said boom and said masts as the load penetrates said vertically extending plane extending upwardly from said pivotal connector, during substantially horizontal rearward movement of the load.

29. The load lifting apparatus as set forth in claim 15, wherein said control radius means retarding extreme rearward pivotings of said boom and said masts by causing said load carrying end of said boom rise, raising the load carried thereby, as said load carrying end of said boom penetrates said vertically extending plane extending upwardly from said pivotal connector; said raising of the load by said load carrying end of said boom acting to retard extreme rearward pivoting of said boom and said masts.

30. A load lifting apparatus for raising a load at a site and moving said load in a substantially horizontal direction to a remote site where said load is lowered and deposited, said load lifting apparatus comprising:

a base support member;

a pivotal connector carried by said base support member;

a substantially vertical extending mast having an upper end and a lower portion;

said lower portion of said mast being pivotally connected on said pivotal connection for being pivoted penetratingly through a vertically extending plane extending upwardly from said pivotal connector;

a substantially horizontally extending boom having a load carrying end and a rear end;

means for suspending said boom on an upper portion of said mast for pendulous movement;

a draw works carried by said base support member;

a load line means extending about said load carrying end of said boom, said upper portion of said mast, and to said draw works for raising and lowering said load;

means for selectively pivoting said mast about said pivotal connector through said vertically extending plane causing said boom to be shifted in a pendulous movement relative to said mast for moving said load carrying end of said boom substantially horizontally after lifting said load off said site;

means causing said load carrying end of said boom to rise as said load carrying end of said boom moves rearwardly, penetrating said vertically extending plane, said rising of said load carrying end of said boom working to raise the load being carried thereon, thereby retarding further rearward movement of said boom and said mast.

31. The load lifting apparatus as set forth in claim 30, wherein said means causing said load carrying end to rise comprising:

a rigid member having a forward end and a rearward end extending above and substantially parallel to said boom;

a brace member fixedly connecting said rigid member to said boom;

a headpin carried in said upper portion of said mast, said forward end of said rigid member being connected adjacent said headpin;

a rigid member connector carried in said rearward end of said rigid member spaced a predetermined distance rearward from said headpin;

a base support member located below said rigid member connector;

a rear restraint extending from said base support connector to said rigid member connector; and said predetermined distance between said headpin and said rigid member connector being such that said restraint allows substantially horizontal movement of said load carrying end of said boom from adjacent said vertically extending plate forward, said predetermined distance also being such that said restraint causes said load carrying end of said boom to rise as said load carrying end of said boom moves rearwardly, penetrating said vertically extending plane.

* * * * *